US005564450A

United States Patent [19]

Sokoloski

[11] Patent Number: 5,564,450

[45] Date of Patent: Oct. 15, 1996

[54] UMBRELLA REPAIR DEVICE

[76] Inventor: Mark A. Sokoloski, 5526 Phelps Luck Rd., Columbia, Md. 21045

[21] Appl. No.: 415,692

[22] Filed: Apr. 3, 1995

[51] Int. Cl.[6] ..... A45B 25/18

[52] U.S. Cl. ..... 135/33.5; 135/33.4; 135/33.2; 135/44

[58] Field of Search ..... 135/44, 37, 33.5, 135/33.4, 33.2, 33.41, 33.6

[56] References Cited

U.S. PATENT DOCUMENTS

| | | | |
|---|---|---|---|
| 2,582,749 | 1/1952 | December | 135/33.5 |
| 2,624,357 | 1/1953 | Cutrone et al. | 135/33.5 X |
| 2,625,947 | 1/1953 | Ferrante | 135/33.5 |
| 2,698,629 | 1/1955 | Hall . | |
| 3,083,540 | 4/1963 | Smith . | |
| 3,572,779 | 3/1971 | Dawson . | |
| 4,019,212 | 4/1977 | Downer . | |
| 4,061,154 | 12/1977 | Cox et al. | 135/33.5 X |
| 4,089,416 | 5/1978 | Sims | 135/33.5 X |
| 4,426,761 | 1/1984 | Sassak . | |
| 4,683,901 | 7/1987 | Mitchell . | |
| 5,068,955 | 12/1991 | Gonet | 135/33.5 X |
| 5,101,844 | 4/1992 | Morrone | 135/33.5 |

FOREIGN PATENT DOCUMENTS

| | | | |
|---|---|---|---|
| 664038 | 1/1952 | United Kingdom | 135/33.5 |

*Primary Examiner*—Wynn E. Wood
*Attorney, Agent, or Firm*—Walter G. Finch; Nancy A. Smith

[57] ABSTRACT

This invention is a device capable of repairing umbrellas which have suffered a separation of fabric from the supporting frame. The device has a housing for the naked support tip and several flaps to hold the umbrella's fabric. The tip of the support frame is pushed into the housing of the device, then the fabric is pulled down to the tip and the device's flaps are closed. The flaps sandwich the fabric and secure it with small teeth and adhesive.

4 Claims, 2 Drawing Sheets

UMBRELLA REPAIR DEVICE

BACKGROUND OF THE INVENTION

It has happened to most everyone at one time or another. Being caught in a rain shower with a defective umbrella is as typical and as upsetting as being caught in a storm without any umbrella at all. Either a gust of wind will invert the fragile protective nylon covering or worse, rip the covering off of one of the support tips.

When the covering has ripped off one of its support tips, the umbrella takes on an embarrassingly pitiful form, its pitifulness increasing as other tips soon follow the separating trend. While the look is far less than professional, the effectiveness of an umbrella with its covering separated from one or more support tips is hopeful at best. The umbrella will allow rain to drain off at the point which is closest to its top, which, on a normal umbrella, will be at any end as the bottom ring is equidistant from the top. However, an umbrella's covering which is separated from the support tip is much closer to the top than the rest of the bottom ring. This will not only allow rain to directly fall unimpeded onto the user, but will also allow rain, which has been blocked by the umbrella's covering, to drain off the short, unattached side and fall indirectly onto the user. This unfortunate situation further accents the pitiful view of the wet user who huddles under the three-quarters of the umbrella which is not yet separated, and is still getting wet.

While an obvious solution to this problem is to purchase or carry a spare umbrella to use when the main umbrella breaks, this method can become burdensome physically and economically. No one enjoys carrying one umbrella much less two. Furthermore, the exact time of failure will not be immediately apparent, and the spare may be carried for an extended period of time without use. A light, inexpensive and quick fix product for the broken umbrella is what is needed to solve this annoying problem.

SUMMARY OF THE INVENTION

This invention relates to an umbrella fixing device, and more particularly, to an umbrella fixing device that will reconnect separated material to its support tip.

The present invention will be able to repair an umbrella whose covering has separated from its support tip. This will be accomplished by a small flexible piece of material designed to engulf the support tip and also attach to the umbrella's material covering. The support tip end of the device will snap securely on the support tip of the umbrella due to differing resilient diameters incorporated into the device. Once secured to the support tip, the device will attach to the umbrella's fabric covering by adhesion of two sets of teethed flaps that are reciprocatingly attached on the upper and lower sides of the umbrella's fabric. This completes the process and reattaches the umbrella covering to the proper support tip and the umbrella as a whole is restored to operational condition.

It is therefore an object of this invention to repair and strengthen a support tip and umbrella fabric union.

It is another object of this invention to strengthen the support tip and umbrella fabric union before breakage to prevent separation.

It is yet another object of this invention to provide an umbrella repair device that is easily used and obtained at minimal cost.

DETAILED DESCRIPTION OF THE DRAWINGS

Figure 1:
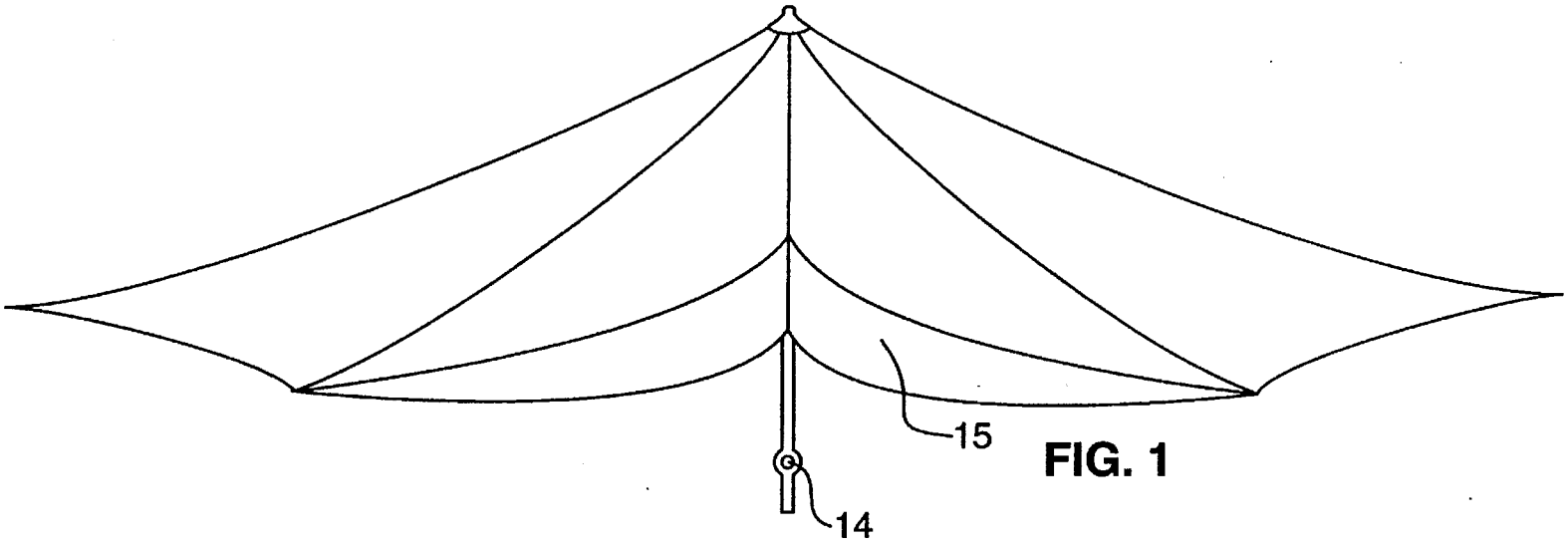
FIG. 1 depicts an umbrella whose covering has separated from its support tip.
Figure 4:
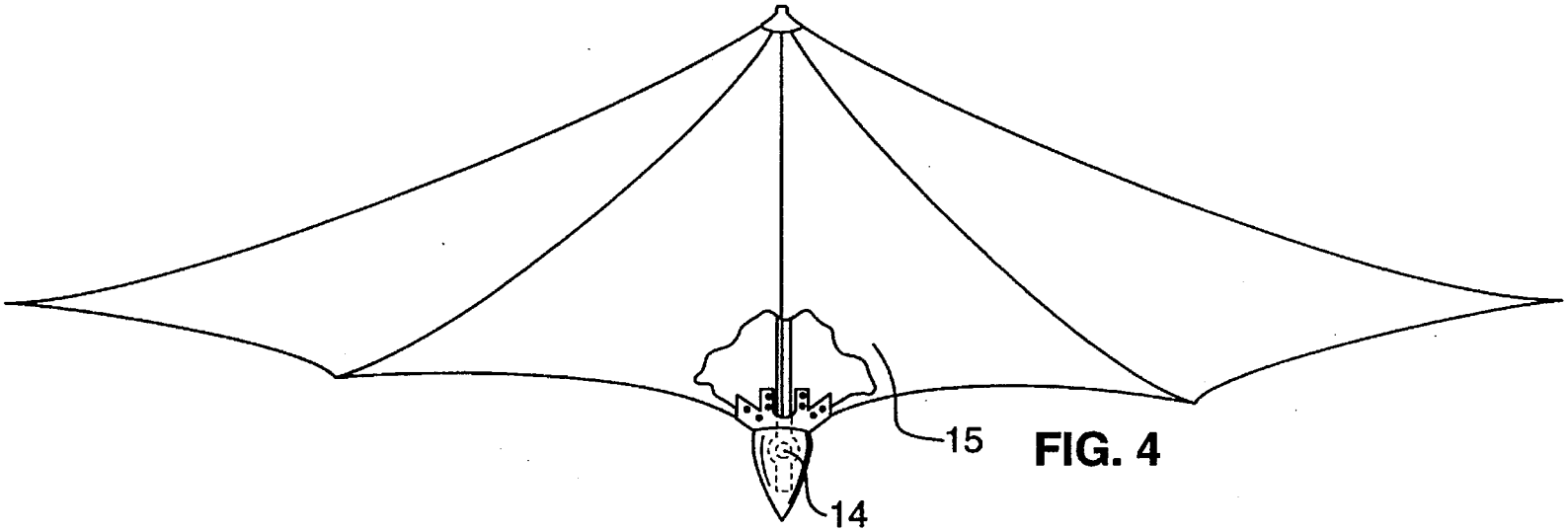
FIG. 4 is a operational view illustrating the umbrella repair device being utilized on an umbrella

This invention is designed to repair umbrellas whose covering 15 has separated from its underlying support tip 14, as illustrated in FIG. 1. The repair device will fit over the support tip 14 of the broken umbrella, and attach to the covering 15 so as to permanently secure the covering 15 onto the support tip 14, as illustrated in FIG. 4.

Figure 2:
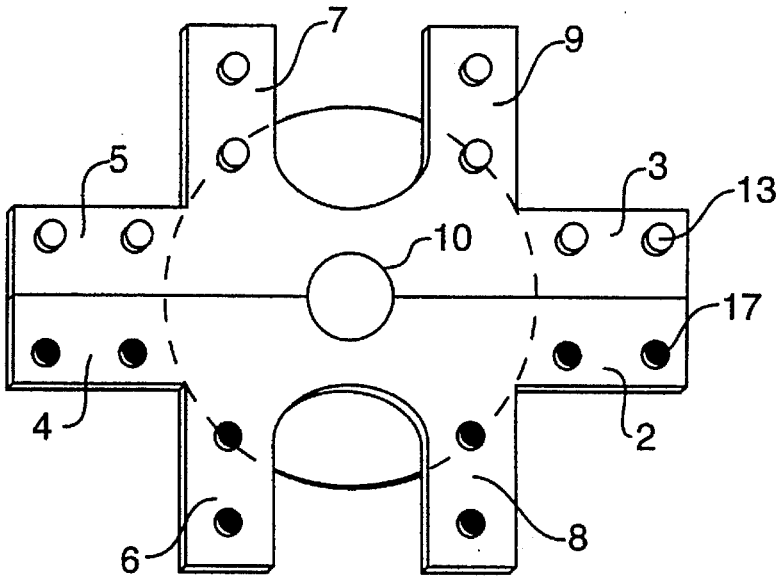
FIG. 2 is a top view of the umbrella repair device shown in partial cross section.
Figure 3:
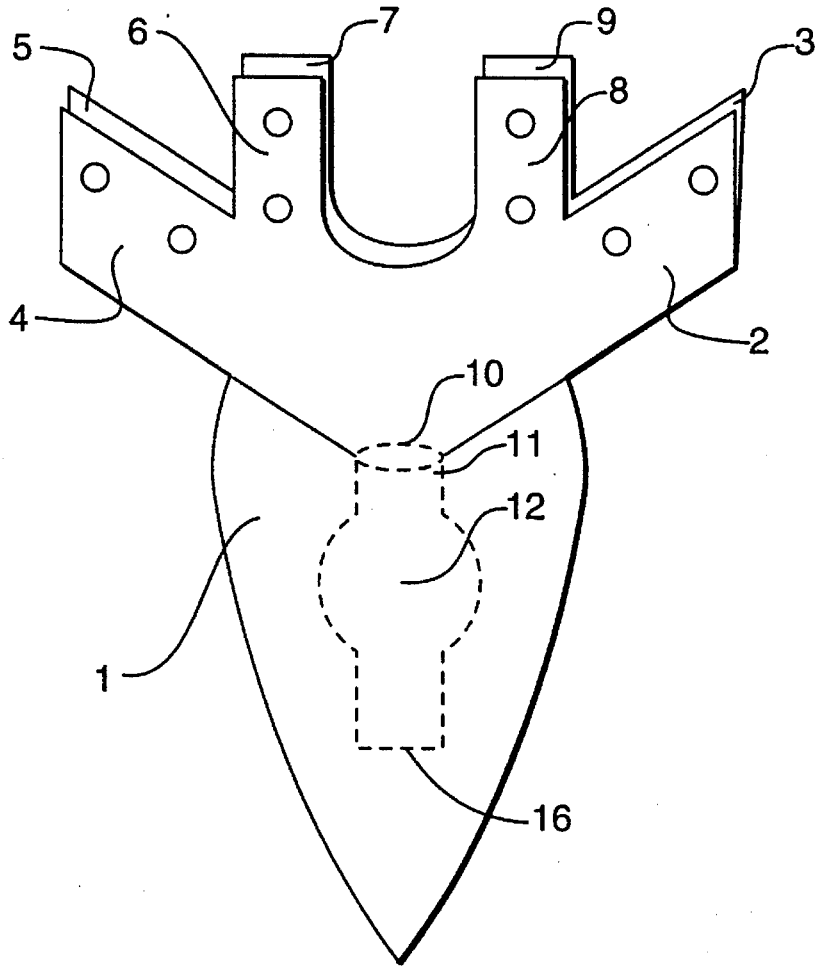
FIG. 3 is a side view of the umbrella repair device.

Referring to FIGS. 2 and 3, the repair device is illustrated in its preferred embodiment. The outer covering of the device 1, will be slightly flexible so as to withstand any surface strain and stress caused by normal operation of the umbrella. The device covering 1 performs two main functions: (1) it encases a substantially rigid hollow core 12 which will house the umbrella's support tip; and (2) it has eight extensions or flaps 2, 3, 4, 5, 6, 7, 8, 9 that extend beyond the covered core 12 which attach to the umbrella's covering 15. The core 12 has a non-uniform diameter, so that it acts as a snapping mechanism for an umbrella tip 14 (seen in FIG. 4). The umbrella tip 14 will enter the device through the core orifice 10 and pass through the narrow section 11 and enter the tip housing 12 where it is then secured. The diameter of the core orifice 10 and the tip housing 12 is slightly smaller than a typical umbrella tip 14; however, the entire core 12 will be pliable enough to allow entry when the user applies force to the umbrella tip 14. While the tip 14 should fit snugly within the core 12, it is not essential to the effectiveness of the device as the umbrella's covering 15, once attached to the device's flaps 2, 3, 4, 5, 6, 7, 8, 9, will place the device's covering 1 in tension whenever the umbrella is opened, thus forcing the umbrella tip 14 and the bottom of the core 16 to remain in direct contact, preventing any chance of the device unsnapping itself.

The device, once securely snapped onto the umbrella's tip 14, is next fastened to the umbrella covering 15 which has separated from the tip 14. This is accomplished by eight flaps 2, 3, 4, 5, 6, 7, 8, 9, four on the top side of the covering 15 and four symmetrically aligned on the bottom side illustrated clearly in FIGS. 2 and 3. In the preferred embodiment, four of these flaps 2, 4, 6, 8, will have a piercing means 13 embedded within their material while the other flaps 3, 5, 7, 9 have an attaching means embedded within them arranged in a pattern correlating to the pattern of the piercing means. FIGS. 2 and 3 show an embodiment utilizing small teeth 13 as the piecing means and small orifices 17 as the attaching means, although the specification is not limited by such as any means of piercing and attaching readily known to a person skilled in the relevant art is intended to be part of this invention's enablement. The teethed flaps 13 pierce either the top or bottom covering of the umbrella and insert, upon hand manipulation of the flaps, into the small orifices 17, which will be located on the opposite side of umbrella's covering 15, so that the umbrella covering 15 is "sandwiched" between the two sets of flaps. A typical application may involve sandwiching of the umbrella covering 15 between four pairs of flaps with flap 2 connecting to flap 3, flap 4 connecting to flap 5, flap 6 connecting with flap 7, and flap 8 connecting with flap 9. To further secure the covering, the flaps will be coated with an adhesive means, such as glue, on the face of each flap which is in direct contact with the umbrella's covering 15. The nature of this type of pierced attachment yields a strong resistance to surface sheer stress as the teeth 13 significantly aid in preventing the umbrella covering from moving or slipping between the closed flaps.

The exact pattern of the device's flaps will be dependant on the differing types of umbrellas as the angles from which the covering 15 leaves either side of a support tip 14 will have slight variations. Furthermore, the core 12 of the device may vary slightly to accommodate all umbrella tips. While a generic device may be manufactured that will effectively, although not aesthetically, repair all covering 15 separation, this enablement is intended to embody all such variations that may be necessary in manufacturing to ensure a custom fit for any particular umbrella.

It is therefore understood that the preceding description is only one embodiment of this invention and that slight variations, such as the number and shape of flaps, the type of piercing and attaching means, and the internal shape of the core, may occur without deviating outside the scope of the claims.

What is claimed is:

1. An umbrella repair device, comprising:

a solid cap having a center hollow portion, said hollow portion having opposite narrow ends connected by a wider central cavity, and said cap being arranged to fit onto the tip of a umbrella;

a plurality of corresponding flaps attached to said cap;

piercing means attached to one half of said flaps; and receiving means attached to the other half of said flaps, such that when a fabric covering of an umbrella is placed between said corresponding flaps said flaps secure said fabric covering over said tip of said umbrella.

2. An umbrella repair device as recited in claim 1 wherein said cap is made of firm flexible material and allowing easy insertion of said tip of said umbrella yet preventing removal of said tip of said umbrella.

3. An umbrella repair device as recited in claim 1 wherein said plurality of corresponding flaps number eight.

4. An umbrella repair device as recited in claim 1 wherein said piercing means are teeth and said receiving means are orifices.

* * * * *